United States Patent [19]

Stevens

[11] Patent Number: 4,646,458

[45] Date of Patent: Mar. 3, 1987

[54] RIMLESS CARTRIDGE EXTRACTOR

[75] Inventor: Frederick F. Stevens, Fairfield, Conn.

[73] Assignee: The Bellmore-Johnson Tool Company, Hamden, Conn.

[21] Appl. No.: 790,729

[22] Filed: Oct. 24, 1985

[51] Int. Cl.[4] ..... F41C 15/06

[52] U.S. Cl. ..... 42/46; 42/47

[58] Field of Search ..... 42/46, 47, 25

[56] References Cited

U.S. PATENT DOCUMENTS

| | | | |
|---|---|---|---|
| 319,482 | 6/1885 | Harder | 42/46 |
| 617,943 | 1/1899 | Weisheit | 42/25 |
| 3,193,960 | 7/1965 | Stevens, Jr. | 42/47 |

*Primary Examiner*—Deborah L. Kyle
*Assistant Examiner*—Michael J. Carone
*Attorney, Agent, or Firm*—McCormick, Paulding & Huber

[57] ABSTRACT

A double barrel derringer has an extractor mechanism which includes a T-shaped extractor element supported in a T-shaped slot which opens laterally outwardly through one side of the barrel and through the breech end thereof and communicates with the cartridge chambers. The extractor engages rimless cartridges disposed with the cartridge chambers within annular extraction grooves formed in the cartridges. A locking strap pivotally supported on the barrel locks the barrel in a closed position. Pivotal movement of the strap to a releasing position allows the barrel to be tilted from its closed position to a loading/unloading position. Further pivotal movement of the locking strap operates the extractor to simultaneouslly partially extract both cartridges from the cartridge chambers. The extractor is arranged for general lateral movement relative to the barrel to release the partially extracted cartridges which may then be dumped or manually removed from the cartridge chambers. A spring arranged between the locking strap and a groove in the extractor biases the extractor towards the cartridge.

11 Claims, 10 Drawing Figures

RIMLESS CARTRIDGE EXTRACTOR

BACKGROUND OF THE INVENTION

This invention relates in general to firearms and deals more particularly with improved rimless cartridge extractor mechanism.

The extractor mechanism for removing a rimless cartridge from the cartridge chamber of a firearm usually includes an extractor element for engaging the cartridge within an annular extraction groove formed in the cartridge case and spaced from the end of the case. In a relatively large firearm it is usually possible to provide an extractor mechanism having an extractor element capable of sufficient movement to fully withdraw an associated cartridge from the cartridge chamber of the firearm. However, in a small handgun it is often not possible to provide the degree of extractor element movement required to effect full cartridge extraction. In such a firearm it may be necessary to provide a means for disengaging the extractor element from a partially extracted cartridge to enable the partially withdrawn cartridge to be dumped or manually removed from the cartridge chamber. The present invention is concerned with this problem.

SUMMARY OF THE INVENTION

In accordance with the present invention a firearm for firing rimless cartridges has an extractor mounted in a laterally outwardly opening slot formed in one side of the firearm. The extractor engages an extraction groove in a rimless cartridge contained within a cartridge chamber of the firearm and is movable rearwardly relative to the cartridge chamber to effect partial extraction of the cartridge. The extractor is further supported for lateral movement out of engagement with the extraction groove when the cartridge is in a partially extracted position to release the cartridge and permit it to be dumped or otherwise removed from the cartridge chamber.

DETAILED DESCRIPTION OF PREFERRED EMBODIMENT

Figure 1:
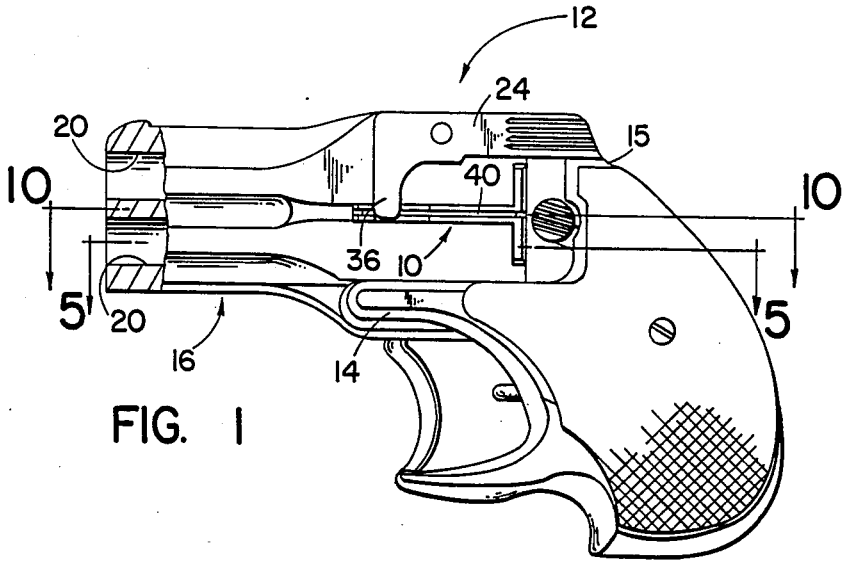
FIG. 1 is a side elevational view of a firearm having an extractor mechanism embodying the present invention.

The extractor mechanism of the present invention, indicated generally at 10, is illustrated and described with reference to a small handgun or derringer designated generally by the reference numeral 12. The illustrated gun 12 is conventional in most respects, consequently only those parts of the gun necessary to a complete understanding of the invention are hereinafter described.

The gun 12 has a frame 14 which defines a receiver 15. A barrel designated generally by the numeral 16 is secured to the frame by a pivot pin 18 for pivotal movement relative to the frame between closed or firing position and an open or loading/unloading position, as will be hereinafter further described. Preferably, and as shown, the barrel 16 has a generally rectangular cross-section and includes parallel bores 20, 20 arranged in over and under relationship to each other. Each bore 20 has a cartridge chamber 22 which opens through the breech end of the barrel for receiving a rimless cartridge. A generally U-shaped locking band or strap 24, pivotally supported on the breech end of the barrel, carries a depending locking finger 36 and in a locking position engages an upwardly extending locking projection on the receiver indicated at 26 to releasably retain the barrel in its closed position.

Figure 5:
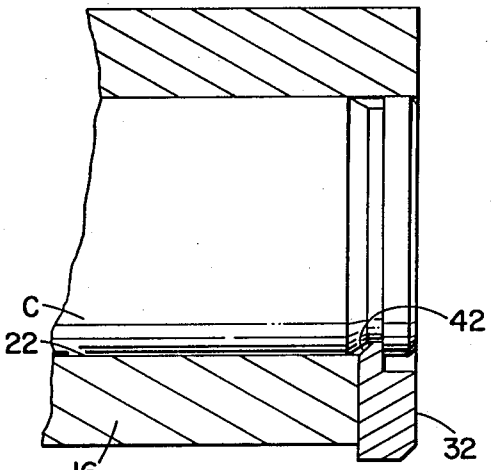
FIG. 5 is a somewhat enlarged fragmentary sectional view taken along the line 5—5 of FIG. 1.
Figure 6:
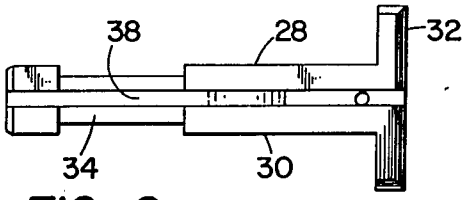
FIG. 6 is a somewhat enlarged side elevational view of the extractor element.
Figure 7:
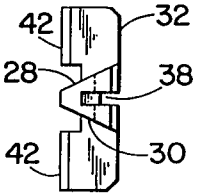
FIG. 7 is a left end elevational view of the extractor element as it appears in FIG. 6.

A pair of firing pins (not shown) are supported within the receiver 15. Each firing pin is aligned in a firing position with an associated cartridge chamber 22 when the barrel is locked in its closed position. The firing mechanism (not shown) is generally conventional and includes a hammer which sequentially strikes the firing pins to fire a cartridge seated in each of the cartridge chambers (One such cartridge C is shown in FIG. 5).

Considering now the extractor mechanism in further detail, the illustrated extractor mechanism 10 is particulary adapted to simultaneously extract two cartridge cases C, C from the firing chambers 22, 22 and has a generally T-shaped extractor element 28, best shown in FIGS. 4–10, which includes a central leg 30 and a cross member 32. The extractor element extractor is received within a generally complimentary T-shaped slot 33 which opens laterally outwardly through one side and through the breech end of the barrel. The elongated central leg 30 has a generally V-shaped cross section which generally complements an associated portion of the slot 33. The extractor element 28 is supported by walls for smooth forward and rearward sliding movement relative to the barrel. A notch 34 formed in the leg 30 opens laterally outwardly and receives the operating finger 36 therein. A longitudinally extending and a laterally opening groove 38 formed in the leg 32 communicates with the notch 34 and receives an elongated resilient spring wire member 40 therein. A portion of the spring wire member 40 disposed within the notch 34 is outwardly bowed in the direction of the operating finger 36 and bears against the inner side of the operating finger for a purpose which will be hereinafter evident. The integral cross member 32 is disposed within the rearwardly opening portion of the slot 33 at the breech end of the barrel. The inner edges of the cross member 32 project for some distance into the cartridge chambers 22, 22 and to a ready position when the barrel is locked in its closed position and are shaped to engage annular grooves in two rimless cartridges C, C seated in the chambers 22, 22. A forwardly facing inner edge of the cross member 32 is slightly chamfered as indicated at 42, and best shown in FIG. 5 and 9.

To load the firearm 12 the rear end portion of the locking strap 24 is raised a sufficient distance to clear the locking projection 26 on the receiver. The barrel is then tilted to its open position to expose the ends of the cartridge chambers 22, 22 to receive cartridges. Two rimless cartridges are then inserted into the chambers. The arrangement of the spring 40 within the notch 34 allows some limited lateral outward movement of the extractor element 28 relative to the barrel 16 to permit cartridges C, C to be inserted into the cartridge chambers 22, 22. The tapered noses of the cartridge exert a camming action upon the extractor cross member 32 to move it laterally outward and away from the cartridge chambers 22, 22 as the cartridges are inserted into the chambers. When the cartridges are fully seated within the chambers the inner edges of the cross member 32 are biased into engagement with the cartridges C, C within the extraction grooves therein by biasing force exerted by the bowed portion of the spring 40 acting upon the inner surface of the operating finger 36. The barrel may then be pivoted to its closed position after which the locking strap 24 is engaged with the locking projection 26 to lock the barrel in its firing position.

Figure 2:
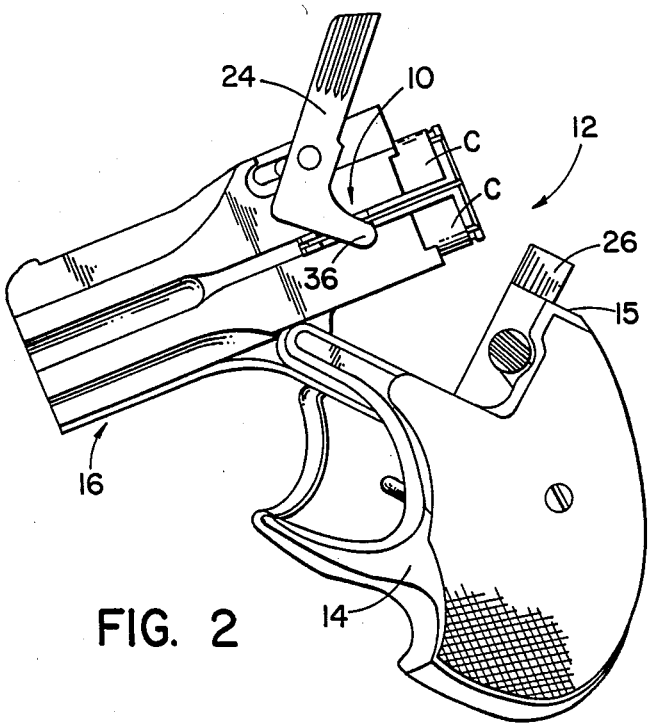
FIG. 2 is similar to FIG. 1 but shows the firearm in a loading/unloading position.
Figure 4:
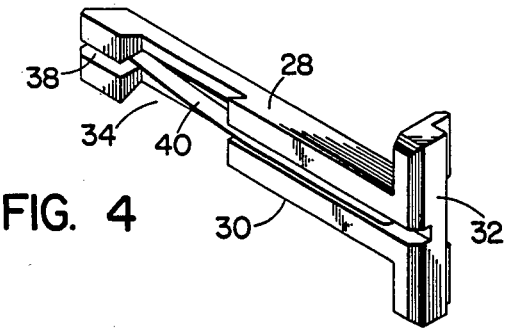
FIG. 4 is a somewhat enlarged perspective view of the extractor.
Figure 3:
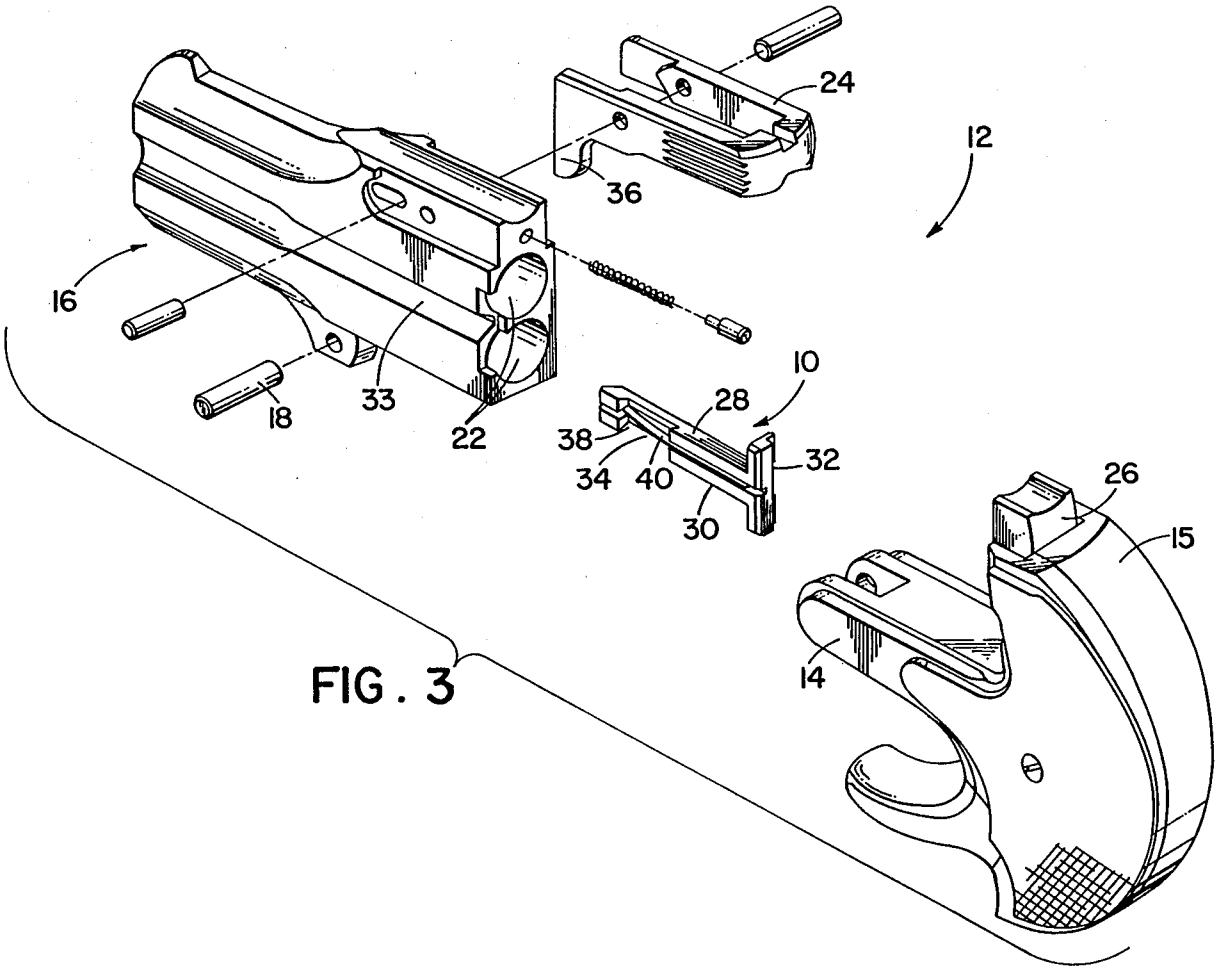
FIG. 3 is a fragmentary exploded perspective view of the firearm shown in FIGS. 1 and 2.
Figure 8:
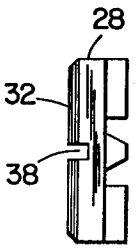
FIG. 8 is a right elevational view of the extractor element as it appears in FIG. 6.
Figure 9:
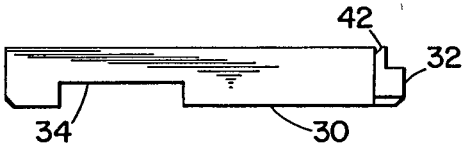
FIG. 9 is a plan view of the extractor element.
Figure 10:
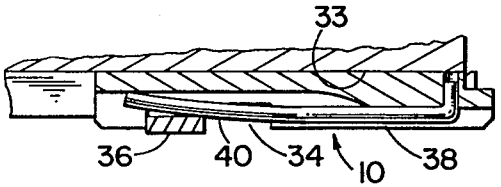
FIG. 10 is a sectional view of the extractor element taken along the line 10—10 of FIG. 1.

After the gun has been fired the spent cartridge shells are extracted by releasing the locking strap 24 and tilting the barrel to its loading/unloading position. The locking strap is moved a sufficient distance in a counterclockwise direction from its position of FIG. 1 to its position of FIG. 2 to bring the operating finger 36 into engagement with a forwardly facing abutment surface which defines the rear of the notch 34 to cam the extractor element 28 rearward to an extracting position which partially withdraws the spent carriages C, C from the cartridge chambers. Thereafter, slight movement of the cross member 32 in a laterally outward direction causes the front end portion of the leg 30 to pivot on the inner surface of the groove 38 and allows the cross number 32 to move out of engagement with the extraction grooves in the cartridges C, C whereupon the spent cartridges may be dumped or otherwise manually removed from the cartridge chambers. The cross number 32 may be easily moved out of holding engagement with the cartridges by engaging a thumbnail with the rear inner edge of the cross member and pulling the cross number in a laterally outward direction.

I claim:

1. A firearm having a frame, a barrel pivotally supported on said frame for movement between an open position corresponding to a loading/unloading position of said firearm and a closed position corresponding to a firing position of said firearm, said barrel including a bore and a cartridge chamber at the breech end of said bore, a rimless cartridge extractor mechanism including an extractor element supported in a slot formed in said frame and opening laterally outwardly through one side of said frame and communicating with said cartridge chamber, said extractor element being movable longitudinally of said frame within said slot between a ready position wherein a portion of said extractor element is disposed within said cartridge chamber for engaging an annular extraction groove in a rimless cartridge disposed within said cartridge chamber and an extracting position wherein the cartridge is at least partially extracted from said cartridge chamber and for generally lateral movement relative to said barrel between a cartridge engaging position wherein said extractor is engagable with a rimless cartridge within the extracting groove in the cartridge and a cartridge releasing position wherein said extractor is out of engagement with the cartridge, means for biasing said extractor laterally inwardly and toward its cartridge engaging position, and locking means supported on said frame to move relative to said frame for clocking said barrel in its closed position and releasing said barrel in its closed position, said locking means being operable for moving said extractor element to an extracting position when said barrel is in an open position, said locking means retaining said biasing means and extractor element in assembly with each other and with said frame.

2. The combination as set forth in claim 1 wherein said locking means comprises a U-shaped locking strap pivotally supported on said barrel and engagable with an associated portion of said frame in a locking position.

3. The combination as set forth in claim 2 wherein said locking strap has an operating finger thereon disposed within a slot in said extractor element for moving said extractor element.

4. The combination as set forth in claim 1 wherein said biasing means comprises a spring acting between said extractor element and said locking means.

5. The combination as set forth in claim 4 wherein said spring comprises a longitudinally elongated generally L-shaped resilient wire received within a longitudinally extending laterally outwardly opening groove in said extractor element and having an end portion thereof received within a complementary opening in said extractor element communicating with said groove.

6. A firearm having a frame defining a receiver and a barrel pivotally supported on the frame for movement relative to the frame between an open position corresponding to a loading/unloading position of said firearm and a closed position corresponding to the firing position of said firearm, said barrel having a pair of bores arranged in over and under relation to each other and a pair of firing chambers, each of said firing chambers being located at the breech end of an associated bore, and an extractor mechanism comprising a generally T-shaped slot formed in one side of said firearm and opening laterally outwardly through said one side and through the breech end of said barrel, a portion of said slot communicating with each of asid cartridge chambers, a T-shaped extractor element received in said slot and supported therein for reciprocal movement in generally parallel relation to said bores between ready and extracting positions, said extractor element in its ready position having portions thereof disposed within said cartridge chambers for engaging annular extraction grooves of rimless cartridges disposed within said chambers, said extractor element being generally laterally movable within said slot and relative to said barrel between cartridge engaging and cartridge releasing positions, means for biasing said extractor element laterally inwardly toward said barrel and said cartridge engaging position, and locking means for locking said barrel in and releasing it from its closed poisition, said locking means being operable for moving said extractor element from its ready position to its cartridge extracting position when said barrel is in its open position, said locking means retaining said extractor element and said biasing means in assembled relation to each other and to said frame.

7. The combination as set forth in claim 6 wherein said biasing means comprises a generally L-shaped spring carried by said extractor element and having an end portion received within a complementary opening in said extractor element.

8. The combination as set forth in claim 6 wherein said locking means includes a locking member carried by said barrel and movable relative to said barrel between locking and releasing positions, said locking member in its locking position engages a portion of said receiver to releasably retain said barrel in its closed position, and said locking means includes a finger projecting from said locking member and disposed within a notch in said extractor element for moving said extractor element within said slot in response to movement of said locking element relative to said barrel.

9. The combination as set forth in claim 8 wherein said spring comprises an elongated piece of resilient spring wire disposed within a longitudinally extending groove in said extractor element and having a laterally outwardly bowed portion disposed within said notch.

10. The combination as set forth in claim 8 wherein said spring acts between said finger and said extractor element.

11. A handgun having a frame defining a receiver and a barrel having a pair of bores arranged in over and under relation to each other and a pair of firing chambers, each of said firing chambers being located at the breech end of an associated bore, means for supporting said barrel on said frame for pivotal movement about an axis extending transversely of said barrel between an open position corresponding to a loading/unloading position of the gun and a closed position corresponding to a firing position of said gun, a generally T-shaped slot formed in one side of said barrel and opening laterally outwardly through said one side and through the breech end of said barrel, a portion of said slot communicating with each of said cartridge chambers, a T-shaped extractor element supported in said slot for reciprocal movement therein in generally parallel relation to said bores between ready and extracting positions said extracting element in its ready position having a portion thereof disposed within said cartridge chambers for engaging annular extraction grooves of rimless cartridges disposed within said chambers, said extractor element being generally laterally movable within said slot and relative to said barrel between cartridge engaging and cartridge releasing positions, said extractor element having a laterally outwardly opening notch therein and a longitudinally extending and laterally outwardly opening groove therein communicating with said notch, means for moving said extractor element from its ready position to its cartridge extracting position and including a generally U-shaped locking strap supported on said barrel for pivotal movement about an axis parallel to the axis of pivotal movement of said barrel, said locking member having a finger projecting therefrom for engaging said extracting member within said notch, said locking strap being engageable with a projection on said receiver in a locking position to releasably retain said barrel in its closed position, and means for biasing said extractor element laterally inwardly toward said barrel and said cartridge engaging position and comprising an elongated L-shaped spring member received within said groove and having a laterally outwardly bowed portion intermediate its ends and disposed within said notch and bearing against said finger, said spring member having an end portion received within a complementary opening in said extractor element communicating with said groove, said U-shaped locking strap retaining said spring member and said extractor element in assembly with each other and with said frame.

* * * * *